US005221915A

United States Patent [19]

Ueda

[11] Patent Number: 5,221,915

[45] Date of Patent: Jun. 22, 1993

[54] THERMAL PROTECTOR

[75] Inventor: Kensaku Ueda, Otsu, Japan

[73] Assignee: Matsushita Electric Industrial Co., Ltd., Osaka, Japan

[21] Appl. No.: 887,516

[22] Filed: May 21, 1992

[30] Foreign Application Priority Data

May 24, 1991 [JP] Japan ..... 3-119836

[51] Int. Cl.[5] ..... H01H 61/02

[52] U.S. Cl. ..... 337/107; 337/102

[58] Field of Search ..... 337/102, 103, 104, 105, 337/106, 107, 112, 377

[56] References Cited

U.S. PATENT DOCUMENTS 3,753,191 8/1973 Dennis ..... 337/112
3,968,468 7/1976 Andersen ..... 337/107
4,287,500 9/1981 Ueda ..... 337/107
4,334,209 6/1982 Dennis ..... 337/112
4,823,104 4/1989 Ekowicki et al. ..... 337/107

FOREIGN PATENT DOCUMENTS 56-42912 10/1981 Japan .

*Primary Examiner*—Harold Broome
*Attorney, Agent, or Firm*—Panitch, Schwarze, Jacobs & Nadel

[57] ABSTRACT

A thermal protector includes a stationary electrode having a contact end connected to the top end of a zigzag plate heater and a snap-acting thermosensitive element having a movable electrode with a contact end connected thereto. The stationary electrode and the movable electrode are opposed to each other and the two contact ends can be open or closed. The stationary electrode and the movable electrode are fixed within a container.

12 Claims, 7 Drawing Sheets

THERMAL PROTECTOR

BACKGROUND OF THE INVENTION

1. Field of the Invention

The present invention relates to a thermal protector used in various kinds of electric components and appliances for protecting the electric components and appliances from over heating and over current accidents due to heating and overcurrent under abnormal conditions.

2. Description of the Prior Art

A conventional thermal protector has the following structure: An electrode mount comprising a movable electrode and a stationary electrode which are fixed with a glass bead so as to oppose to each other is contained in a glass envelope. The glass envelope is pinch-sealed by melting an opening thereof located under the glass bead. After being exhausted and filled with gas, the glass envelope is hermetically sealed by tipping off the top thereof. Such a structure is described in Japanese Utility Model Publication No. 56-42912.

The thermal protector with the above-mentioned structure is provided on a heating unit of various kinds of electric components and appliances. When a temperature of the unit is raised or an excess current flows through the unit due to some abnormality or other, a snap-acting and thermo-sensitive element of the movable electrode is reversed in order to be removed from the stationary electrode, thereby as a protective function shutting the current to the electric components or appliances.

Recently, as the electric components and appliances are made compact, there has been a desire for developing a thermal protector with a small size and an excellent opening sensibility in a low current region.

However, in the above-mentioned conventional structure, the desired opening sensibility of a compact thermal protector in a low current region cannot be obtained even if a resistance wire of a nickel-chromium alloy is used as a lead wire of the stationary and the movable electrodes in the glass envelope.

SUMMARY OF THE INVENTION

The thermal protector of this invention comprises a stationary electrode; a movable electrode which is integrated with the stationary electrode and includes a snap-acting and thermo-sensitive element coming in and losing contact with the stationary electrode; and a container for the stationary electrode and the movable electrode, wherein a part of the stationary electrode is a zigzag plate heater, and the plate heater is opposed to the snap-acting thermo-sensitive element.

Alternately, the thermal protector according to the present invention comprises a stationary electrode; a movable electrode including a snap-acting thermo-sensitive element coming in and losing contact with the stationary electrode; a frit glass bead for integrating the stationary electrode and the movable electrode; and a container for the stationary electrode and the movable electrode which are integrated by the frit glass bead, wherein a part of the stationary electrode is a zigzag plate heater, the plate heat is opposed to the snap-acting thermo-sensitive element, a gap between the frit glass bead and an opening of the container is filled with frit glass paste, and the frit glass paste is fused by heating to seal the opening of the container.

Alternately, the thermal protector according to the present invention comprises a stationary electrode; a movable electrode including a snap-acting thermo-sensitive element coming in and losing contact with the stationary electrode; a glass bead for integrating the stationary electrode and the movable electrode; and a container for the stationary electrode and the movable electrode which are integrated by the glass bead, wherein a part of the stationary electrode is a zigzag plate heater, the plate heater is opposed to the snap-acting thermo-sensitive element, and the opening of the container is fused in order to be sealed.

Thus, the invention described herein makes possible the objective of providing a compact thermal protector having an improved opening sensitivity in a low current region.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
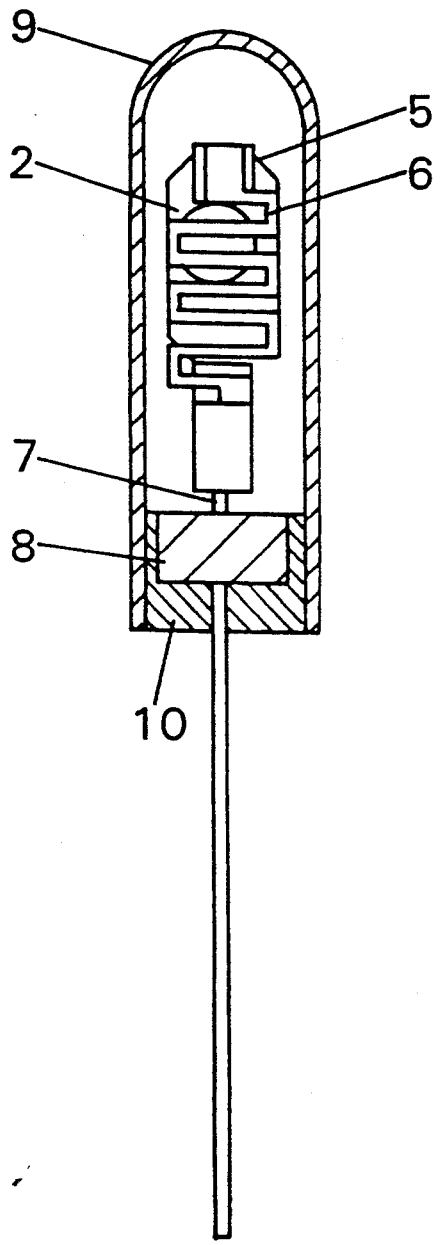
FIG. 1 is a front elevation, partly broken away, of a thermal protector according to a first example of the present invention.
Figure 2:
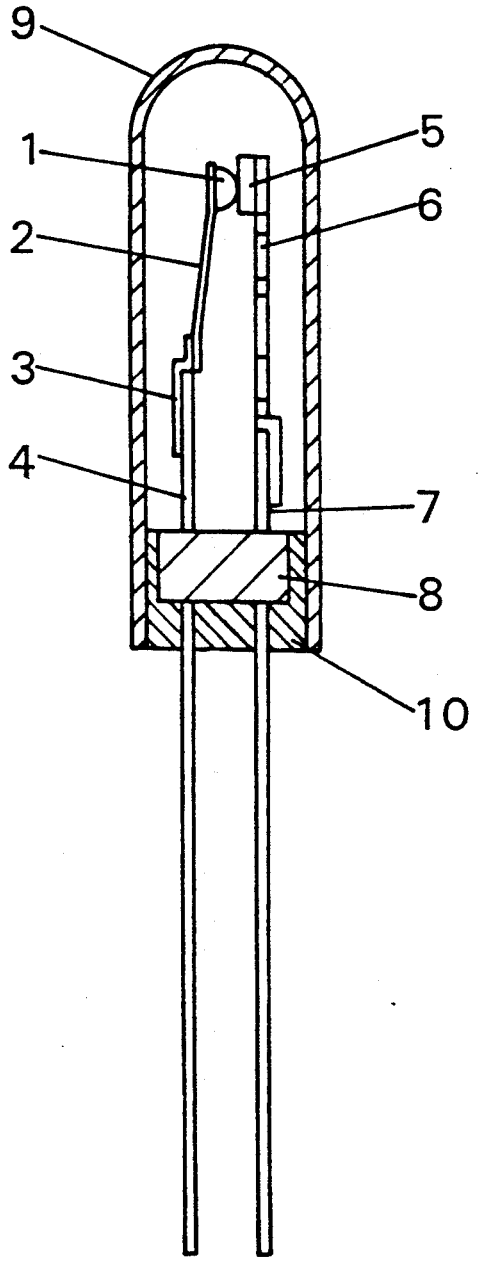
FIG. 2 is a side elevation, partly broken away, of the thermal protector of FIG. 1.
Figure 3:
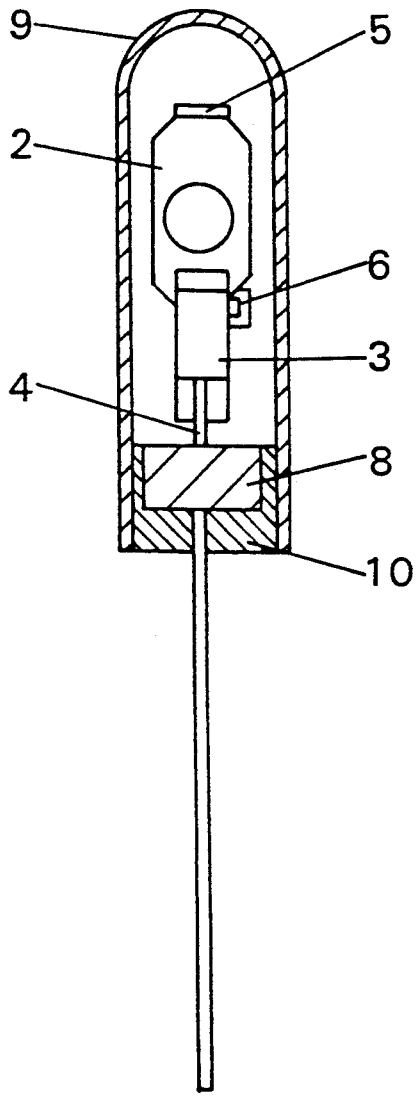
FIG. 3 is a rear elevation, partly broken away, of the thermal protector of FIG. 1.

Referring to FIGS. 1, 2 and 3, a structure of a thermal protector according to a first example of the present invention will now be described. A movable contact 1 is welded onto a top end of a snap-acting and thermo-sensitive element 2 (hereinafter called the "snap-acting element"). The top end of a formed metal plate 3 is welded onto a bottom end of the snap-acting element 2. A movable electrode lead wire 4 is welded onto the bottom end of the formed metal plate 3. Thus, a movable electrode is formed. A stationary contact 5, which is in contact with the movable contact 1 with a predetermined contact pressure, is provided on the top end of a zigzag plate heater 6 comprising a resistance plate of, for example, a nickel-chromium alloy, a nickel-chromium-iron alloy or an iron-chromium alloy. A stationary electrode lead wire 7 is welded onto the bottom end of the zigzag plate heater 6. Thus, a stationary electrode is formed. The movable electrode and the stationary electrode are integrated with a crystallized frit glass bead 8 by a pressed sintering so as to have the two electrodes oppose each other, thereby forming an electrode mount. The plate heater 6 is opposed to the snap-acting element 2.

Figure 4:
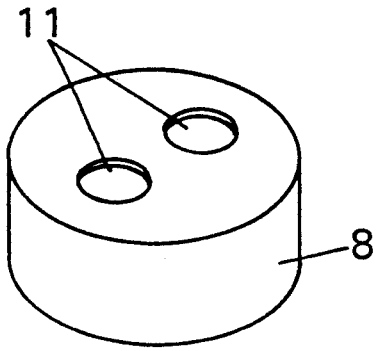
FIG. 4 is an enlarged perspective view of a frit glass bead in the thermal protector of FIG. 1.

As shown in FIG. 4, the frit glass bead 8 is provided with two openings 11, through which the lead wires 4 and 7 are inserted, respectively. By fusing the bead with a burner and the like, the openings 11 are respectively sealed with the lead wires.

The thus obtained electrode mount is contained in a glass envelope 9. A gap between an opening of the glass envelope 9 and the frit glass bead 8 is filled with frit glass paste made of boric lead silicate glass with a low melting point (which is obtained by combining frit glass and an organic binder). After drying the paste with warm air, the paste is fused by heating with a burner and the like. Thus, the gap between the opening of the glass envelope 9 and the frit glass bead 8 is hermetically sealed, thereby forming a sealing unit 10.

After the glass envelope 9 is heated and exhausted, the glass envelope 9 is filled with clean dried air. Then, a top surface is tipped off.

In the thermal protector of the first example of the present invention with the above described structure, the zigzag plate heater 6 is provided as a part of the stationary electrode opposing the snap-acting element 2 of the movable electrode. Therefore, this zigzag plate heater 6 provides sufficient heat, which causes a heat conduction to sufficiently heat the snap-acting element 2 sufficiently. This allows the snap-acting element 2 to work with a low current and results in an improvement of an opening sensitivity of the thermal protector.

Moreover, a means for heating the snap-acting element 2 is not provided separately, but provided as the zigzag plate heater 6, a part of the stationary electrode. Thus, the glass envelope 9 can be small, because the electrode mount is not bulky. This prevents the thermal protector from becoming large. Further, the total length of the thermal protector according to the present invention can be shorter than that of the conventional one. The sealing unit 10 of this example is formed by sealing the gap between the opening of the glass envelope 9 and the frit glass bead 8 integrating the stationary electrode and the movable electrode with frit glass paste. On the contrary, in the conventional thermal protector, an opening of the glass envelope, which is located under a glass bead, is fused to be sealed by heating. In this way, the thermal protector with a compact size can be provided.

Figure 5:
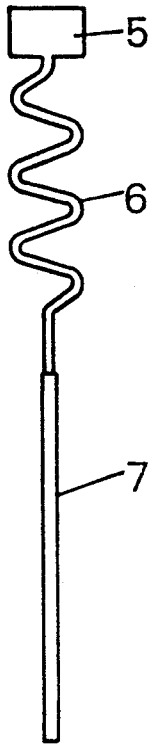
FIG. 5 is a front elevation showing a modified example of a stationary electrode.
Figure 6:
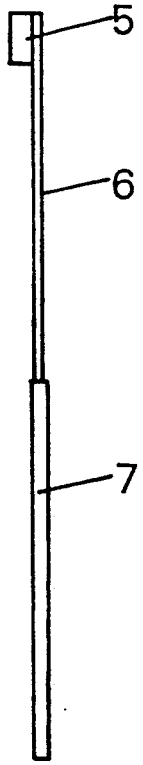
FIG. 6 is a side elevation of the stationary electrode of FIG. 5.

FIGS. 5 and 6 show a modified example of the stationary electrode. In this case, the stationary electrode is formed by using a wire of Nichrome and the like as the zigzag plate heater 6. The wire is folded in a zigzag shape, and the stationary contact 5 and the stationary electrode lead wire 7 are welded on the first and second ends thereof, respectively.

A thermal protector (the present invention) was produced so as to have a structure as shown in FIG. 1 and a size as shown in Table 1. A responsive time to a current was measured, thereby obtaining results as shown in Table 2. As a comparative example, another thermal protector according to the prior art was produced to measure the responsive time to a current. As the zigzag plate heater according to the present invention, a plate of a nickel-chromium alloy with a thickness of 0.5 mm was used. In the prior art thermal protector, a nickel-chromium alloy wire with a diameter of 0.7 mm was used as a stationary electrode lead wire. An opening temperature of both samples was set to be 140° C.

TABLE 1

| Dimension of the Glass Envelope: | | |
|---|---|---|
| | Sample of the prior art | Sample of the present invention |
| Maximum diameter | 8 mm (100%) | 6.2 mm (78%) |
| Total length | 34.5 mm (100%) | 20.5 mm (59%) |
| Outer volume | 1530.7 $mm^3$ (100%) | 618.6 $mm^3$ (40%) |

TABLE 2

| Responsive Time to Current (25° C.): | | |
|---|---|---|
| Current | Sample of the prior art | Sample of the present invention |
| 4 amperes | 19 sec. | 6.6 sec. |
| 3 amperes | 70 sec. | 15.2 sec. |
| 2 amperes | no response | 60.0 sec. |

As is obvious from Tables 1 and 2, the thermal protector of the present invention has such an improved sensitivity it can respond to a low current of 2 amperes in approximately 60 seconds, to which the conventional thermal protector did not respond. Further, the thermal protector of the present invention is minimized by 60% in a volume ratio as compared with a conventional one.

Figure 7:
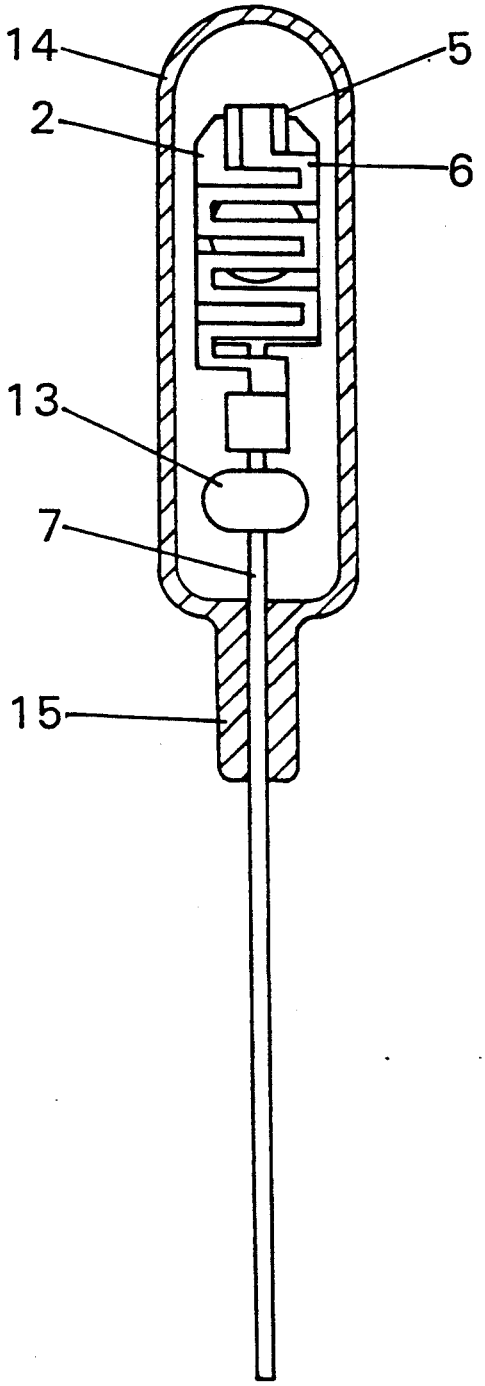
FIG. 7 is a front elevation, partly broken away, of a thermal protector according to a second example of the present invention.
Figure 8:
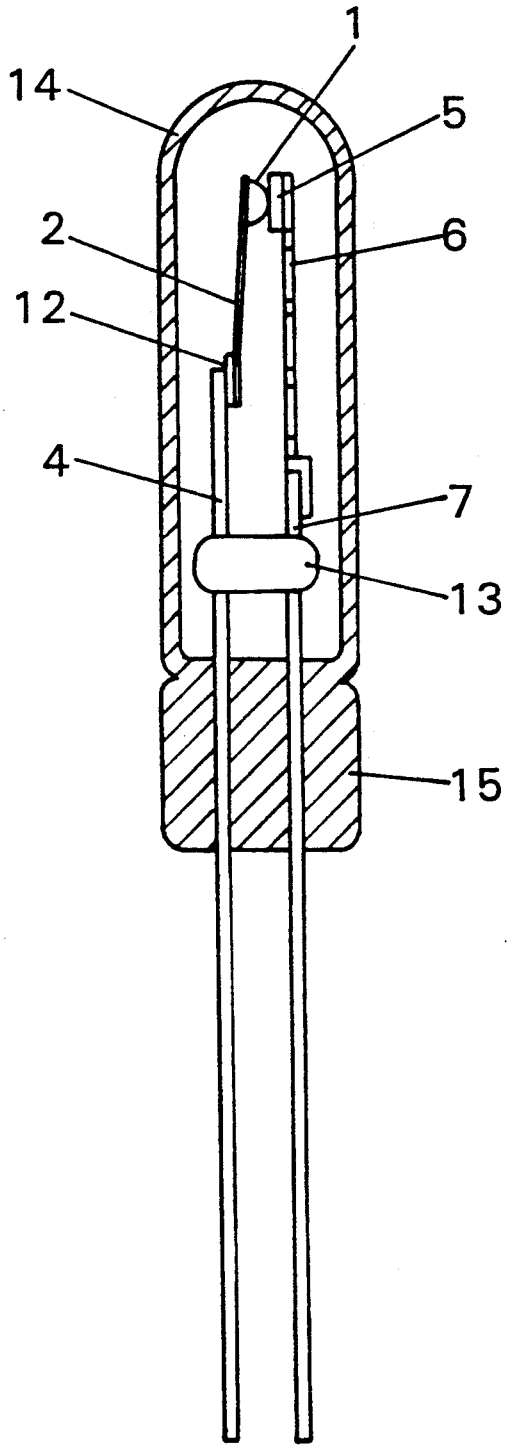
FIG. 8 is a side elevation, partly broken away, of the thermal protector of FIG. 7.
Figure 9:
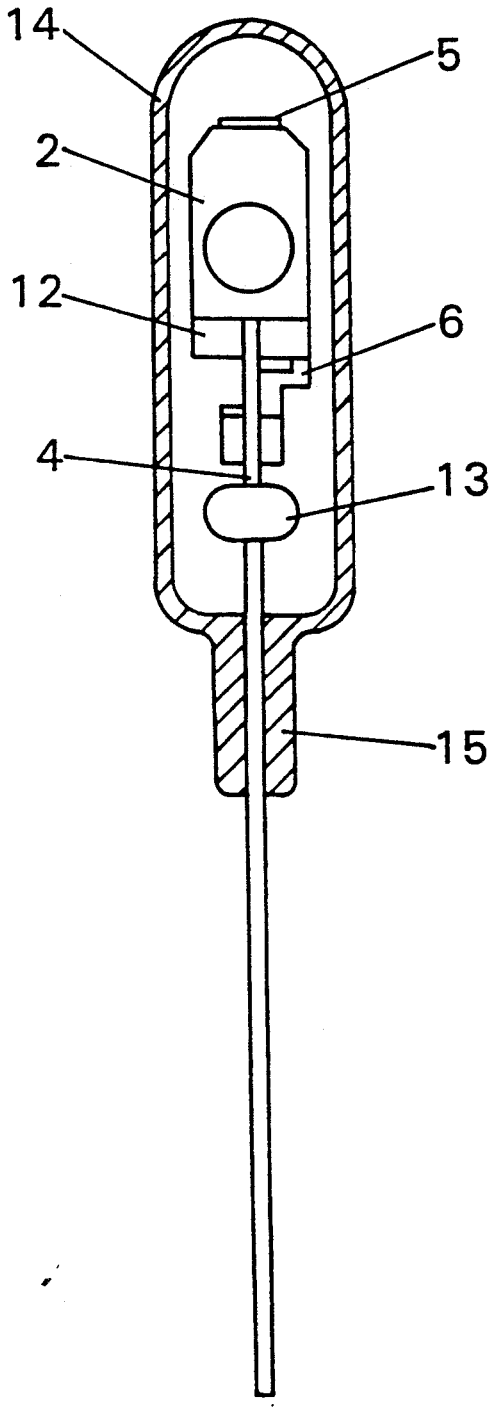
FIG. 9 is a rear elevation, partly broken away, of the thermal protector of FIG. 7.

FIGS. 7, 8 and 9 show a thermal protector according to a second example of the present invention. A structure of this example is as follows: A movable contact 1 is welded on a first end of a snap-acting element 2. A first end of a metal plate 12 is welded on a second end of the snap-acting element 2. A second end of the metal plate 12 is welded to a movable electrode lead wire 4. Thus, a movable electrode is formed. A stationary contact 5, which is in contact with the movable contact 1 with a predetermined contact pressure, is provided on a first end of a zigzag plate heater 6, which comprises a resistance plate made of, for example, a nickel-chromium alloy, a nickel-chromium-iron alloy or an iron-chromium alloy. A stationary electrode lead wire 7 is welded on a second end of the zigzag plate heater 6. Thus, a stationary electrode is formed. The movable electrode and the stationary electrode are integrated with a glass bead 13 so as to oppose the two electrodes to each other, thereby forming an electrode mount. The plate heater 6 is opposed to the snap-acting element 2.

The thus obtained electrode mount is contained in a glass envelope 14, which is then pinch-sealed by heating to fuse an opening thereof to form a sealing unit 15. After the glass envelope 9 is heated and exhausted, the glass envelope 9 is filled with clean dried air. Then, a top surface is tipped off.

Since the thermal protector with the above-mentioned structure has a sealing portion 15 of the pinch-sealed opening of the glass envelope 14, the glass envelope is only a little smaller than the conventional one. Therefore, the thus provided thermal protector is not so small as the one described in the first example, in which the electrode mount is sealed by melting the bead together with the glass envelope. However, the thermal protector of this example is provided with the zigzag plate heater 6 as a part of the stationary electrode lead wire 7. The zigzag plate heater 6 can provide a sufficient heat, which causes heat conduction to sufficiently heat the opposing snap-acting element 2. Therefore, the snap-acting element 2 can work with a low current, thereby providing an improved opening sensitivity of almost the same extent as that of the thermal protector according to the first example.

This thermal protector according to the second example can be effectively adopted in a conventional thermal protector without changing an attachment thereof.

Moreover, also in this example, a resistance wire of Nichrome and the like folded in a zigzag shape can be used as shown in FIGS. 5 and 6.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A thermal protector comprising:

a stationary electrode having a contact end, and a zigzag plate heater having a top end wherein the contact end is connected to the top end of the zigzag plate heater;

a movable electrode having a contact end, and a snap-acting thermosensitive element having a top end wherein the contact end is connected to the top end of the snap-acting thermosensitive element and the stationary electrode and the movable electrode are opposed such that the zigzag plate heater and the movable electrode are directly opposite each other and the contact end of the stationary electrode and the contact end of the movable electrode can be open or closed; and a container wherein the stationary electrode and the movable electrode are fixed therein.

2. A thermal protector according to claim 1, wherein the plate heater is made of a nickel-chromium alloy, a nickel-chromium-iron alloy or an iron-chromium alloy.

3. A thermal protector according to claim 1, wherein the plate heater is made of a resistance wire folded in a zigzag shape.

4. The thermal protector of claim 1 wherein the zigzag plate heater has a bottom end which forms a bottom end of the stationary electrode.

5. A thermal protector comprising:

a stationary electrode having a contact end, and a zigzag plate heater having a top end wherein the contact end is connected to the top end of the zigzag plate heater;

a movable electrode having a contact end, and a snap-acting thermosensitive element having a top end wherein the contact end is connected to the top end of the snap-acting thermosensitive element and the stationary electrode and the movable electrode are opposed such that the zigzag plate heater and the movable electrode are directly opposite each other and the contact end of the stationary electrode and the contact end of the movable electrode can be open or closed; and a frit glass bead integrating the stationary electrode and the movable electrode; and a container having an opening filled with a frit glass paste and a gap between the glass bead and the opening wherein the stationary electrode and the movable electrode are fixed in the container and the frit glass paste is fused by heating so as to seal the opening of the container.

6. A thermal protector according to claim 5, wherein the plate heater is made of a nickel-chromium alloy, a nickel-chromium-iron alloy or an iron-chromium alloy.

7. A thermal protector according to claim 5, wherein the plate heater is made of a resistance wire folded in a zigzag shape.

8. The thermal protector of claim 5 wherein the zigzag plate heater has a bottom end which forms a bottom end of the stationary electrode.

9. A thermal protector comprising:

a stationary electrode having a contact end, and a zigzag plate heater having a top end wherein the contact end is connected to the top end of the zigzag plate heater;

a movable electrode having a contact end, and a snap-acting thermosensitive element having a top end wherein the contact end is connected to the top end of the snap-acting thermosensitive element and the stationary electrode and the movable electrode are opposed such that the zigzag plate heater and the movable electrode are directly opposite each other and the contact end of the stationary electrode and the contact end of the movable electrode can be open or closed; and a glass bead integrating the stationary electrode and the movable electrode; and a container having an opening wherein the stationary electrode and the movable electrode are fixed therein and the opening is fused by heating so as to seal the opening of the container.

10. A thermal protector according to claim 9, wherein the plate heater is made of a nickel-chromium alloy, a nickel-chromium-iron alloy or an iron-chromium alloy.

11. A thermal protector according to claim 9, wherein the plate heater is made of a resistance wire folded in a zigzag shape.

12. The thermal protector of claim 9 wherein the zigzag plate heater has a bottom end forming the bottom end of the stationary electrode.

* * * * *